US007736174B2

(12) United States Patent
Bhosale et al.

(10) Patent No.: US 7,736,174 B2
(45) Date of Patent: Jun. 15, 2010

(54) ILLUMINATED FACE RECEPTACLE STRUCTURE

(75) Inventors: Vikramsinh P. Bhosale, Syracuse, NY (US); Joshua P. Haines, Marcellus, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 362 days.

(21) Appl. No.: 11/949,865

(22) Filed: Dec. 4, 2007

(65) Prior Publication Data

US 2009/0141477 A1 Jun. 4, 2009

(51) Int. Cl.
*H01R 3/00* (2006.01)
*H01R 13/60* (2006.01)
*H01V 1/10* (2006.01)

(52) U.S. Cl. ..... 439/490; 439/535; 365/95

(58) Field of Classification Search ..... 439/490, 439/225, 535; 362/95, 560; 174/66; 315/323
See application file for complete search history.

(56) References Cited

U.S. PATENT DOCUMENTS 2,612,597 A 9/1952 Sherrard
3,265,888 A 8/1966 Adolphson, Jr.
4,755,913 A 7/1988 Sleveland
5,277,620 A 1/1994 Taylor
5,485,356 A 1/1996 Nguyen
5,601,451 A 2/1997 Driones et al.
6,089,893 A 7/2000 Yu et al.
6,109,760 A 8/2000 Salatrik et al.
6,642,452 B2 11/2003 Masson
6,827,602 B2 12/2004 Greene et al.
6,995,525 B2 2/2006 Barthelmess
7,036,948 B1 5/2006 Wyatt
7,121,707 B2 * 10/2006 Currie et al. ..... 362/555
7,402,060 B1 * 7/2008 Buzil et al. ..... 362/95

* cited by examiner

*Primary Examiner*—Chandrika Prasad
(74) *Attorney, Agent, or Firm*—Daniel P. Malley; Bond, Schoeneck & King, PLLC

(57) ABSTRACT

The present invention is directed to an electrical wiring device having a body and a cover coupled to the body including a receptacle face structure which forms an interior region with at least one reflective surface. At least one light emitting device is disposed in the interior region which is configured to emit illumination into at least one neutral opening and a hot opening.

59 Claims, 10 Drawing Sheets

ILLUMINATED FACE RECEPTACLE STRUCTURE

BACKGROUND OF THE INVENTION

1. Field of the Invention

The present invention relates generally to electrical wiring devices, and particularly to illuminated electrical wiring devices.

2. Technical Background

The typical electrical distribution system includes one or more branch electrical circuits connected to a panel breaker disposed at a convenient location in the structure. The breaker panel terminates the AC power service provided by the power utility and distributes AC power to the aforementioned branch electric circuits installed within the structure. The size of the breaker panel may vary depending on whether it is disposed within a residence, commercial building or some other such facility. Branch electric circuits typically include a series of "daisy-chained" electrical wiring devices, such as receptacle outlets, GFCIs, switches, etc.

The electrical wiring devices are provided in electrically non-conductive housings that include hot and neutral line terminals, configured to be connected to the electrical wiring coupled to the breaker panel, and hot and neutral load terminals. The non-conductive housing electrically insulates the line terminals from the load terminals. The load terminals are connected to downstream wiring that is configured to propagate AC power to one or more downstream electrical loads. The load terminals may also be referred to as "feed-through" terminals. The housing is configured for mounting in an outlet box disposed in the branch electric circuit, or, alternatively the housing itself is the final enclosure such as for self-contained wiring devices, multiple outlet strips (MOS), raceway, extension cords, or power adapters.

Certain types of faults are known to occur in branch electric circuits and electrical wiring systems. These faults represent serious safety issues that may result in fire, shock or electrocution if not addressed properly. Accordingly, each branch circuit typically employs one or more electric circuit protection devices. Protective devices employ a circuit interrupter disposed between the line terminals and the load terminals. The circuit interrupter provides power to the load terminals under normal conditions, but breaks electrical connectivity when the protective device detects a fault condition in the load circuit. There are several types of electric circuit protection devices including ground fault circuit interrupters (GFCIs), ground-fault equipment protectors (GFEPs), arc fault circuit interrupters (AFCIs), transient voltage surge suppressors (TVSSs) and surge protective devices (SPDs). This list includes representative examples and is not meant to be exhaustive. Some devices include combinations of GFCIs, AFCIs and SPDs.

As is commonly known, receptacle outlet wiring devices include duplex receptacle outlets that accommodate electrical power plugs. This includes receptacle outlet wiring devices provided with a circuit protection device, a switch, a sensor or some other feature. The plugs, of course, are connected to a portable electrical load by an electrical cord and provide AC power thereto. Examples of such portable electrical loads include vacuum cleaners, hairdryers, lamps, televisions, electronic devices, appliances, etc.

One issue that is of great concern relates to the visibility of a GFCI or receptacle outlet. Electrical outlets are often disposed a little more than a foot from the floor in many installations making them difficult to locate when the face cover matches the wall surface. In other situations, items of furniture or other such things may partially obscure an outlet, again, making it difficult to locate. In another scenario, the amount of ambient lighting in a given area or room may be at a relatively low level.

Of course, one can think of any number of situations wherein it is desirable to locate and use an outlet when the level of illumination in a room is low. For example, a parent may wish to enter a children's bedroom to plug in a night light, a vaporizer or some other such device without having to turn the overhead light ON. In another example, one may wish to plug a portable electrical load into a wall socket in an area where the lighting is purposely kept at a low level, such as a photographic dark room, movie theatre, etc. In each of these instances a person must first find an available electrical outlet, that is, one that is not in use, in a suitable location. Once this is accomplished, the person must align the blades of the plug with the receptacle openings before inserting the blades into the openings. Of course, if the space is darkened, the process may not be performed without a good deal of fuss and bother.

In another scenario, an electrical fault condition may occur, tripping a circuit interrupter disposed in either a wall mounted GFCI device or in the breaker panel. Of course, the tripping action would result in the electrical outlets in the branch circuit being deenergized. As noted above, some fault conditions may result in fire. It may be beneficial to provide a visual indication that an outlet or a series of daisy-chained outlets were deenergized.

In one approach that has been considered, a neon light bulb has been disposed with the receptacle face to provide illumination. One drawback to this approach relates to the amount and quality of the illumination provided at the receptacle face. An intensely bright image of the energized neon light, that is, a so-called "hot spot," is visible on the exterior surface of the receptacle face. One unintended consequence of this arrangement is that it makes the receptacle openings difficult to find because they are masked by the hot spot. Of course, hot spots are not aesthetically pleasing and tend to annoy after awhile.

What is needed is an aesthetically pleasing illuminated receptacle outlet that may be easily located within a darkened room or area. What is also needed is a wiring device configured to direct illumination into a set of receptacle openings without generating a hot spot, allowing the user to align the plug blades with the receptacle openings without any additional ambient lighting. What is further needed is an illuminated wiring device that indicates, at a glance, whether or not the device is energized or deenergized.

SUMMARY OF THE INVENTION

The present invention addresses the needs described above by providing an aesthetically pleasing illuminated receptacle outlet that may be easily located within a darkened room or area. The wiring device of the present invention is configured to direct illumination into the receptacle openings without forming a hot spot, allowing the user to align the plug blades with the receptacle openings without any additional ambient lighting. The present invention also is directed to an illuminated wiring device that indicates, at a glance, whether or not the device is energized or deenergized.

One aspect of the present invention is directed to an electrical wiring device that includes a body member including a hot line terminal interface element and a neutral line terminal interface element accessible from an exterior portion of the body member. The body member also includes a hot load contact structure electrically coupled to the hot line terminal interface element and a neutral load contact structure electrically coupled to the neutral line terminal interface element, both the hot load contact structure and the neutral load contact structure being disposed in an interior portion of the body member. A cover member is coupled to the body member and including at least one receptacle face structure. The at least one receptacle face structure includes a set of receptacle outlet openings formed in a substantially planar portion thereof. The set of receptacle outlet openings includes a neutral opening and a hot opening in alignment with the neutral load contact structure and the hot load contact structure, respectively, the at least one receptacle face structure forming an interior region including at least one reflective surface formed therein. A light emission circuit assembly includes at least one light emitting device disposed in the interior region. The at least one light emitting device being is offset a predetermined distance from an interior surface of the substantially planar portion. The at least one light emitting device is configured to emit illumination in a plane that is substantially parallel to the interior surface such that the emitted illumination is diffusely reflected by the at least one reflective surface onto the interior surface of the planar portion and into the neutral opening and the hot opening.

In another aspect, the present invention is directed to an electrical wiring device that includes a body member including a hot line terminal interface element and a neutral line terminal interface element accessible from an exterior portion of the body member, the body member also including a hot load contact structure electrically coupled to the hot line terminal interface element and a neutral load contact structure electrically coupled to the neutral line terminal interface element. Both the hot load contact structure and the neutral load contact structure are disposed in an interior portion of the body member. A cover member is coupled to the body member and including at least one receptacle face structure. The at least one receptacle face structure includes a set of receptacle outlet openings formed in a planar portion thereof. The set of receptacle outlet openings includes at least a neutral opening and a hot opening in alignment with the neutral load contact structure and the hot load contact structure, respectively, the at least one receptacle face structure forming an interior region including at least one reflective surface formed therein. A light emission circuit assembly includes a printed circuit board disposed in alignment with the interior region and at least one light emitting device disposed on the printed circuit board. The printed circuit board and the at least one light emitting device are offset a predetermined distance from an interior surface of the planar portion. The at least one light emitting device is configured to emit illumination in a plane that is substantially parallel to the planar portion such that the emitted illumination is diffusely reflected by the at least one reflective surface onto the interior surface of the planar portion and into the neutral opening and the hot opening.

In yet another aspect, the present invention is directed to an electrical wiring device that includes a body member including a hot line terminal interface element and a neutral line terminal interface element accessible from an exterior portion of the body member. The body member also includes a hot load contact structure electrically coupled to the hot line terminal interface element and a neutral load contact structure electrically coupled to the neutral line terminal interface element. Both the hot load contact structure and the neutral load contact structure are disposed in an interior portion of the body member. A cover member is coupled to the body member and including at least one receptacle face structure. The at least one receptacle face structure includes a set of receptacle outlet openings formed in a planar portion thereof. The set of receptacle outlet openings includes at least a neutral opening and a hot opening in alignment with the neutral load contact structure and the hot load contact structure, respectively. The at least one receptacle face structure forms an interior region including at least one reflective surface formed therein. A light emission circuit assembly includes a printed circuit board disposed in alignment with the interior region and at least one light emitting device disposed on the printed circuit board. The printed circuit board and the at least one light emitting device are offset a predetermined distance from an interior surface of the planar portion. The at least one light emitting device is configured to emit illumination in a plane that is substantially parallel to the planar portion. An optically transmissive protective shutter assembly is coupled to the at least one light emitting device and disposed in the at least one receptacle face structure between the set of receptacle outlet openings and the hot load contact structure and the neutral load contact structure. The protective shutter assembly is configured to move from a closed position to an open position in response to engaging a set of plug blades. The optically transmissive protective shutter assembly is configured to direct at least a portion of the emitted illumination onto the planar portion, the neutral opening and the hot opening.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Reference will now be made in detail to the present exemplary embodiments of the invention, examples of which are illustrated in the accompanying drawings. Wherever possible, the same reference numbers will be used throughout the drawings to refer to the same or like parts.

Figure 1:
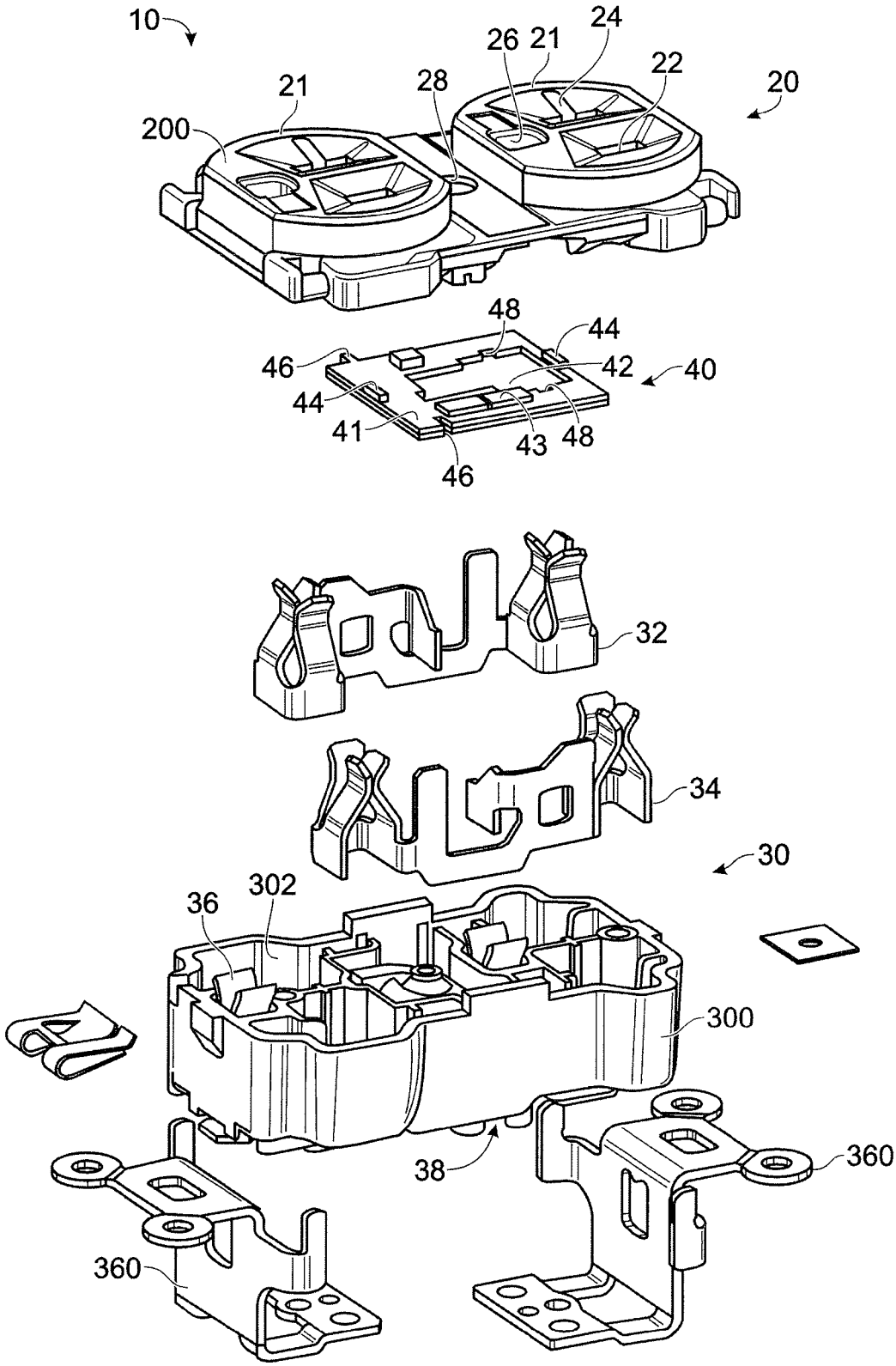
FIG. 1 is an exploded perspective view of a first embodiment of an electrical wiring system according to the present invention.

As embodied herein and depicted in FIG. 1, an exploded perspective view of a first embodiment of an electrical wiring system according to the present invention is disclosed. The electrical wiring system 10 includes a front cover assembly 20, a back body assembly 30, and a light assembly 40.

The front cover assembly 20 includes a front cover member 200 that includes two face receptacles 21 formed at either end. Each face receptacle 21 has a hot blade opening 22, a neutral blade opening 24, and a ground prong openings 26 formed in the substantially planar top surface thereof. A mounting screw hole 28 is disposed between each face receptacle 21. A light assembly 40 is disposed within an interior portion of the front cover assembly 20 in manner described herein.

The back body assembly 30 includes a body member 300 that has various compartments 302 formed therein. The compartments 302 are formed to accommodate a neutral load terminal structure 32, a hot load terminal structure 34 and a ground contact 36 structure. The body member also includes a rear receptacle 38 formed therein. The rear receptacle 38 accommodates a line plug (not shown in this view) for providing power to the electrical device 10. The body member 300 also includes a mounting assembly 360 that is used to attach device 10 to an electrical box.

The light assembly 40 may be implemented using a printed circuit board (PCB) 41. An aperture 42 is formed in a central portion of the PCB 41 to accommodate various structural features formed or disposed in front cover assembly 20. An LED assembly 44 is formed at either end of the PCB 41. The LED assemblies 44 are coupled to various circuit elements disposed on PCB 41 via conductive line tracings formed therein. Power connection leads 46 are connected to the conductive line tracings and are configured to provide power to the light assembly circuit.

In one embodiment, the light assembly circuit disposed on the PCB 41 may include, for example, a current rectifying diode in series with LEDs 44 if the power is AC power, and one or more current limiting resistors. Accordingly, the light assembly 40 is configured to emit light when power is being supplied to the electrical system 10.

In another embodiment of the present invention, a lens element is disposed in the cover member 200 adjacent to the screw hole 28. The lens is configured to direct the ambient light toward an ambient light sensor disposed on PCB 41. In this embodiment, the sensor is implemented using a light sensing diode that generates current in an amount related to the amount of incident ambient light. Alternatively, the sensor is implemented using a light sensitive material whose electrical resistance is related (either directly or inversely) to the amount of incident ambient light. The sensor is connected to a control circuit. The control circuit may include a potentiometer coupled to a Darlington transistor pair. As the ambient light increases past a predetermined level (adjusted by the potentiometer in the factory), the Darlington transistor pair are turned OFF. When the ambient light begins to decrease, e.g., as night falls, below the predetermined level, the transistors are turned ON, energizing LEDs 44. Reference is made to U.S. patent application Ser. No. 11/998,369 and U.S. Patent Application Ser. No. 11/933,956 and U.S. patent application Ser. No. 11/294,167, which are incorporated herein by reference as though fully set forth in its entirety, for a more detailed explanation of the lens element and the light assembly 40 featuring the above described ambient light sensor, respectively.

Figure 2:
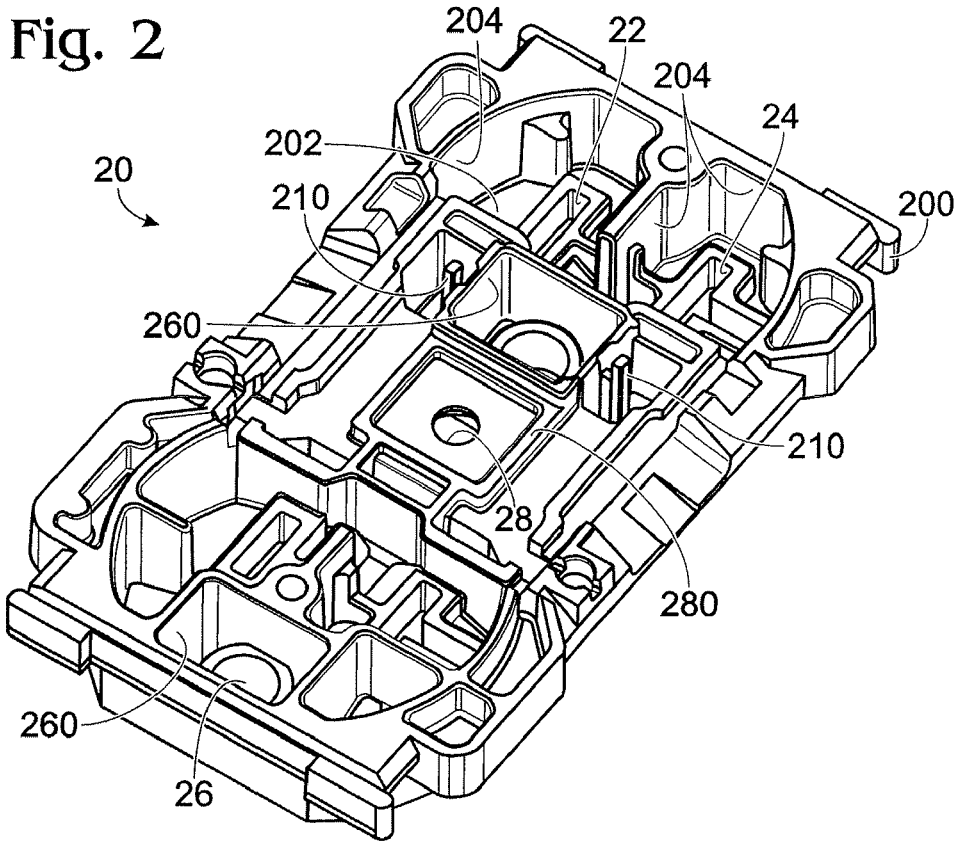
FIG. 2 is a perspective view of a cover member of the first embodiment.

Referring to FIG. 2, a perspective view of the interior portion of the cover assembly depicted in FIG. 1 is shown. The front cover member 200 includes a face receptacle interior region 202 formed at either end. Each interior region 202, of course, corresponds to the interior region formed by the face receptacles 21 depicted in FIG. 1. The side-wall portion of the interior region 202 includes a light reflecting surface 204. Of course, the hot blade opening 22 and the neutral blade opening 24 are visible at the bottom of the interior region 202. Each ground prong opening 26 includes an electrically isolating wall that forms rectangular chamber 260. The chamber 260 that is disposed adjacent to screw hole opening 28 has two PCB mounting posts 210 disposed on either side thereof. The function of the mounting posts 210 will be described below.

Figure 3:
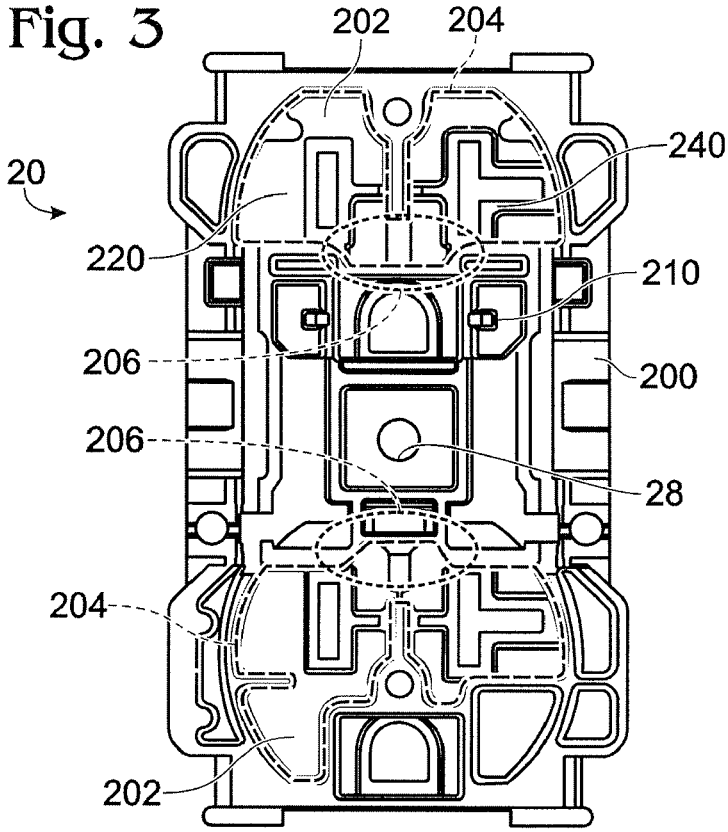
FIG. 3 is a back side view of the FIG. 2 cover member.

Referring to FIG. 3, a plan view of the interior portion of the cover assembly 200 is shown. This view clearly shows the disposition of LED illumination region 206 within region 202. As will be described in greater detail below, LEDs 44 are mounted in the LED illumination region 206. The axis of illumination of the LEDs 44 is substantially parallel to the plane formed by the longitudinal axis and the latitudinal axis of cover member 200. Accordingly, the light emitted in region 206 is directed toward the light reflecting surfaces 204 such that the illumination is reflected and diffused. On the other hand, the LEDs are configured such that illumination is not directed onto the floor 220 of the neutral blade opening 22 or the floor 240 of the hot blade opening 24.

Note that the geometry of surface 204 includes curves, corners, discontinuities and contours that tend to reflect and diffuse the emitted light. The light reflecting surfaces 204 may be formed using any suitable injected molded plastic material that exhibit suitable reflectivity. In another embodiment, the plastic material may be polished to enhance reflectivity. In yet another embodiment, the plastic surface may be covered by a reflective material such as a metallic paint. As noted previously, the light emitted by LEDs 44 is not emitted directly into the hot and neutral plug blade openings (22, 24) but is, instead, diffusely reflected thereto. As such, no so-called hot spots are formed on the face receptacles 21 or anywhere else on the front cover member. The light that does ultimately "leak" from the hot plug blade opening 22 and the neutral plug blade opening 24 is soft and diffuse. In a darkened ambient environment, the face receptacles 21 cannot be seen but for the illuminated shapes of openings (22, 24).

Figure 4:
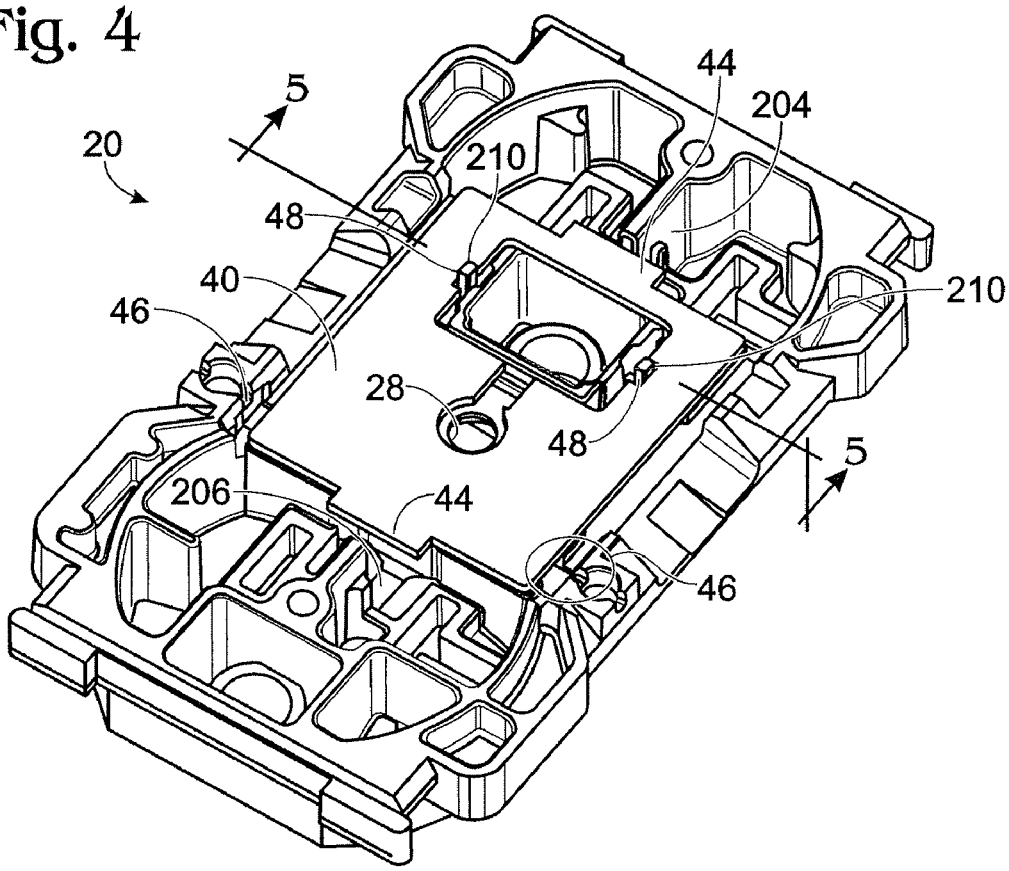
FIG. 4 is a perspective view of a portion of the first embodiment.

Referring to FIG. 4, a perspective view of the interior portion of the cover assembly depicted in FIG. 1 with the light assembly 40 installed therein. As shown, the notch 48 in PCB 41 mates with the mounting post 210 such that LED 44 is positioned in the LED illumination region 206. Note also that power connection leads 46 extend a predetermined distance above the plane formed by PCB 41. Of course, the power connection leads ultimately mate with a portion of the neutral terminal structure 32 and the hot terminal structure 34. The aperture 42 is shaped, sized and positioned within PCB 41 to accommodate rectangular chamber 260 and to permit passage of a screw through central screw hole 28. The aperture 42 depicted in FIG. 4 is a modified version of the one shown in FIG. 1.

Figure 5:
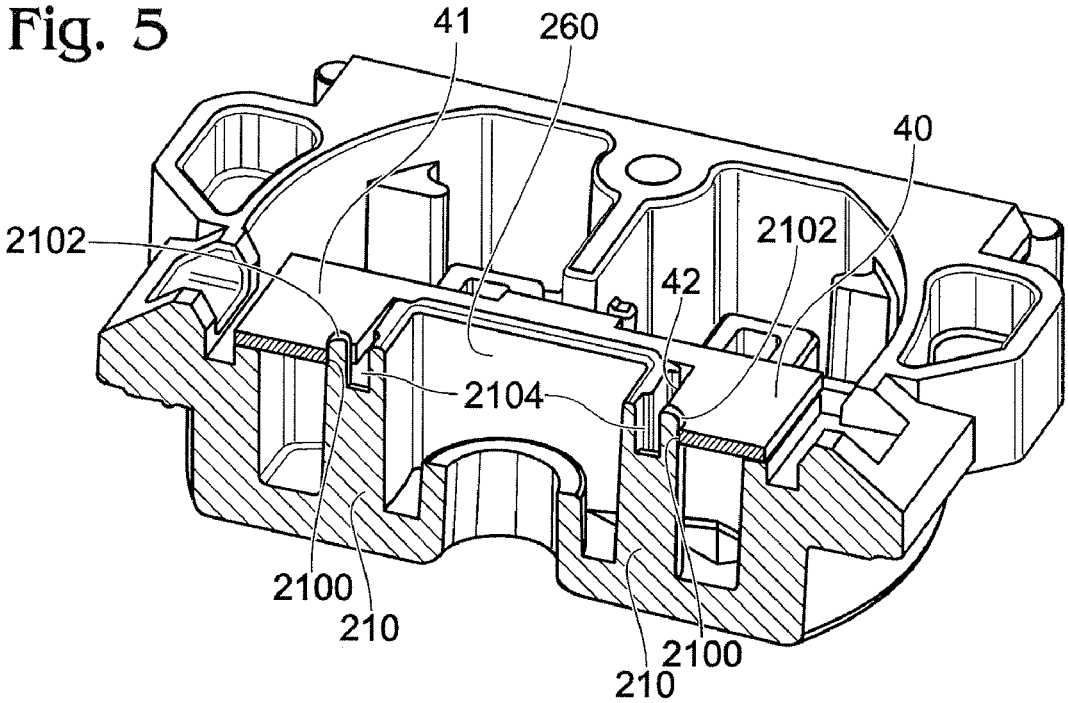
FIG. 5 is a cross sectional view taken across cross section lines A-A in FIG. 4.

Referring to FIG. 5, a cross-sectional view taken across cross section lines A-A in FIG. 4 is shown. This is a detail view of the mechanism used to connect PCB 41 to the front cover assembly 20. The mounting post 210 includes a chamfer 2100 and a protruding clip 2102. The gap 2104 between mounting post 210 and rectangular ground prong chamber 260 allows the mounting post 210 to flex inwardly. Thus, when the PCB 41 is pressed into place with cover member 200, the mounting clip 2102 flexes inwardly until PCB 41 is securely captured within the chamfer 2100. The mounting post 210 relaxes and the protruding clip is seated against the top surface of PCB 41. Those of ordinary skill in the art will appreciate that other suitable structures may be employed to secure light assembly 40 to cover assembly 20.

Figure 6:
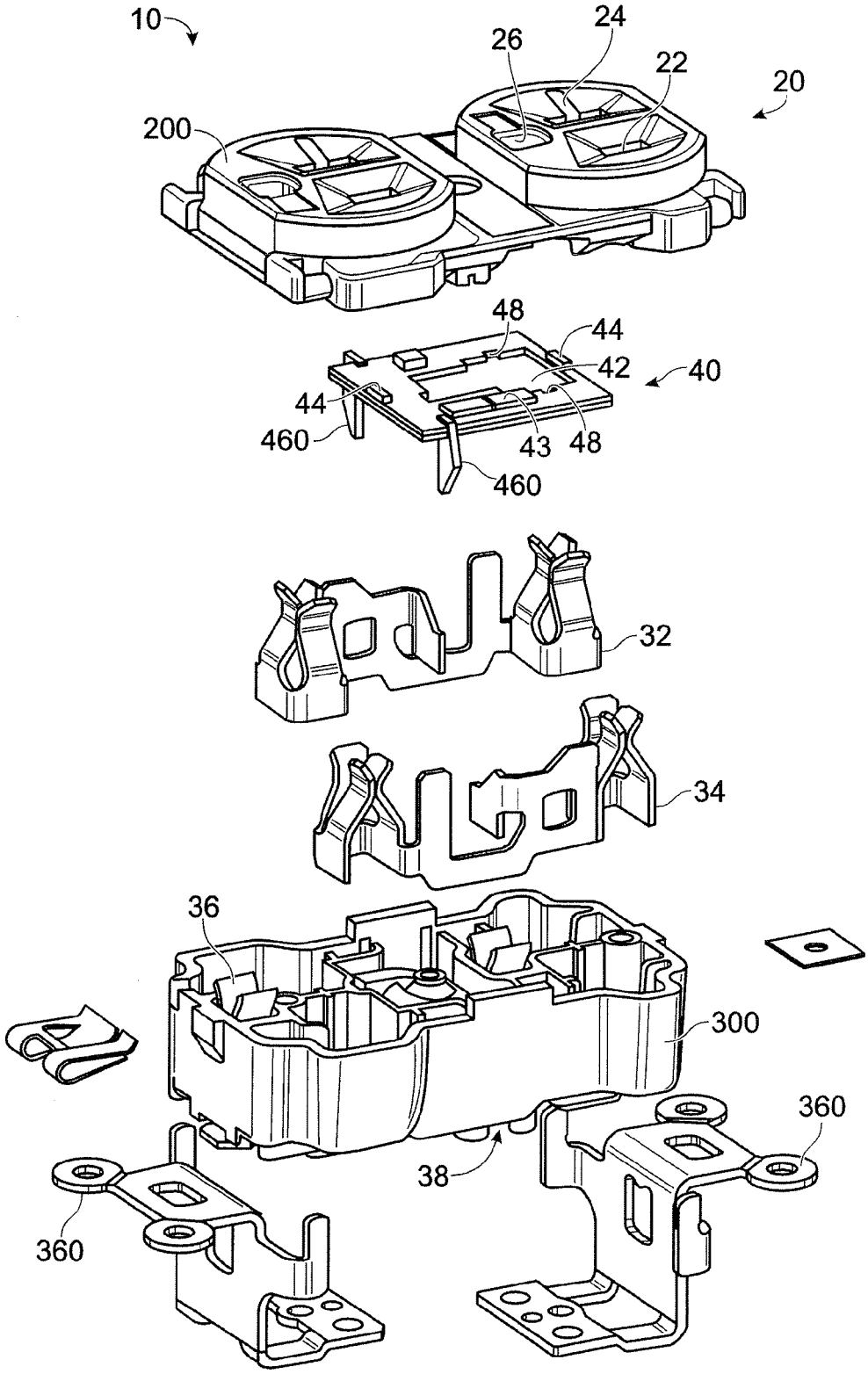
FIG. 6 is an exploded perspective view of a second embodiment of an electrical wiring system according to the present invention.

As embodied herein and depicted in FIG. 6, an exploded perspective view of a second embodiment of an electrical wiring system according to the present invention is disclosed. The first embodiment and the second embodiment are essentially identical with the exception of the means for connecting PCB 41 to the neutral terminal structure 32 and the hot terminal structure 34. In particular, the leads 46 employed in the first embodiment are replaced by power connection clips 460. The power connection clips 460 are configured to flex when they are inserted between their respective terminal structures and the inside walls of the back body 300.

Figure 7:
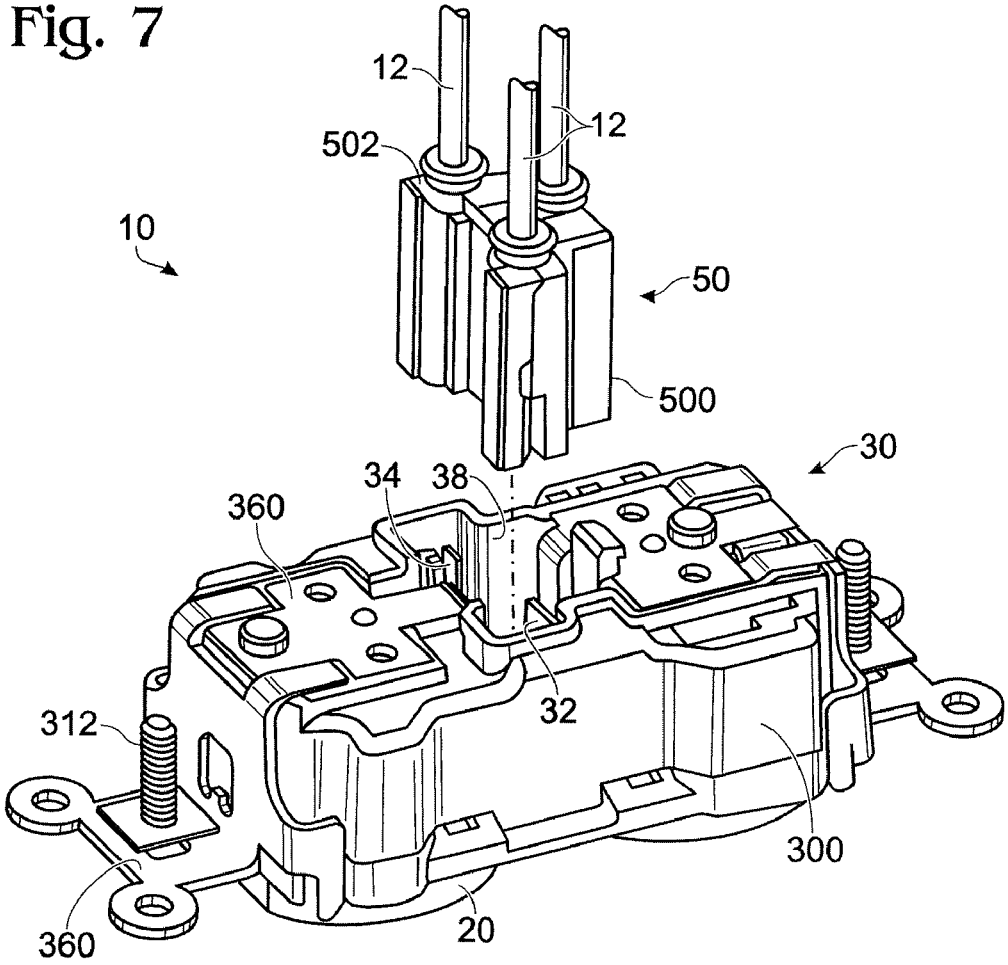
FIG. 7 is a perspective view of a rear portion of the electrical wiring system in accordance with the first and second embodiments of the present invention.

Referring to FIG. 7, a perspective view of a rear portion of the electrical wiring system in accordance with the first and second embodiments of the present invention is shown. The electrical wiring system 10 includes plug connector 50 which mates with a receptacle 38 formed in the rear of body member 300. Electrical power conductor wires 12 are terminated by the plug assembly 50. The plug assembly 50 includes a housing 500, and contacts disposed within body 500. Of course, the connector contacts are female contacts designed to accept the portions of neutral terminal structure 32 and hot terminal structure 34 disposed within the rear receptacle 38. The cover 20, rear body 30 and the plug assembly housing 500 may be formed from injection molded plastic, polycarbonate, or other polymer based materials. The terminal structures (32, 34) as well as connector contacts 202, may be fabricated using a copper alloy material or other suitable conductive materials.

Figure 8:
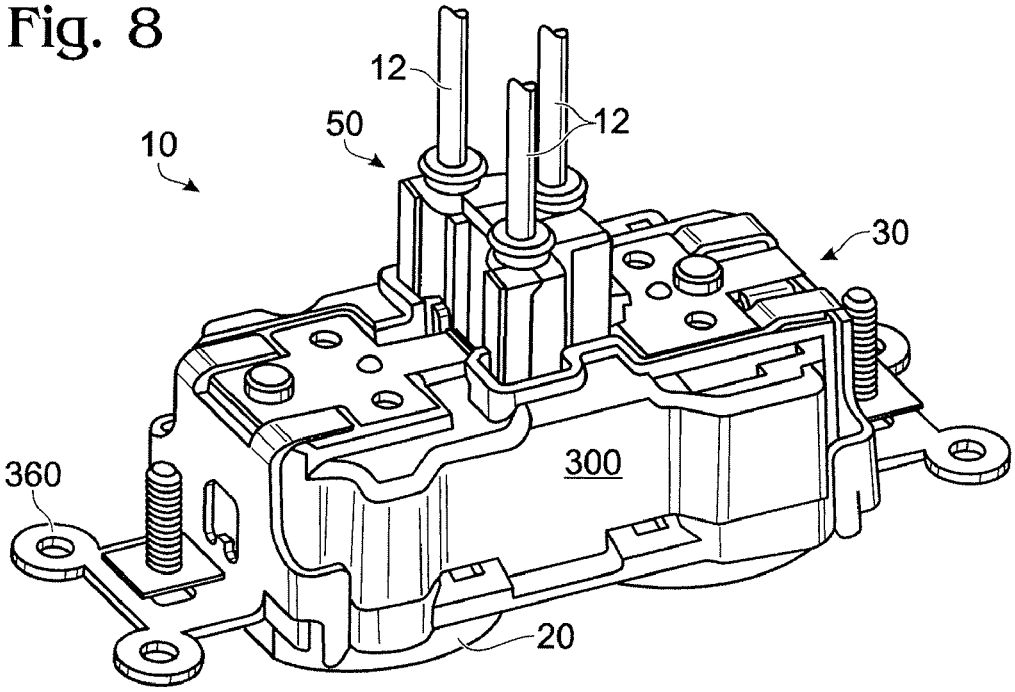
FIG. 8 is a perspective view of the rear portion of the electrical wiring system shown in FIG. 7 being connected to a plug connector.

FIG. 8 is a perspective view of the rear portion of the electrical wiring system shown in FIG. 7 being connected to a plug connector. In the example depicted herein, three wires are shown being terminated by plug 50. However, those of ordinary skill in the art will recognize that the present invention should not be construed as being limited to the embodiment shown. The present invention may be configured to accommodate 2 wire systems and three-phase (5 wires) systems, as well as the 3-wire system shown. Further, system 10 of the present invention may be adapted to a wiring system that employs more than 5 wires. While wires are shown being terminated by a single plug 50, those of ordinary skill in the art will recognize that the present invention may be configured to terminate the wires separately or in combination, within a plurality of plugs.

Reference is made to U.S. Pat. Nos. 6,994,585; 7,195,517; and 7,285,009, which are incorporated herein by reference as though fully set forth in its entirety, for a more detailed explanation of various embodiments of an electrical wiring device with a rear receptacle 38 and a mating plug connector assembly 50 as shown herein.

Figure 9:
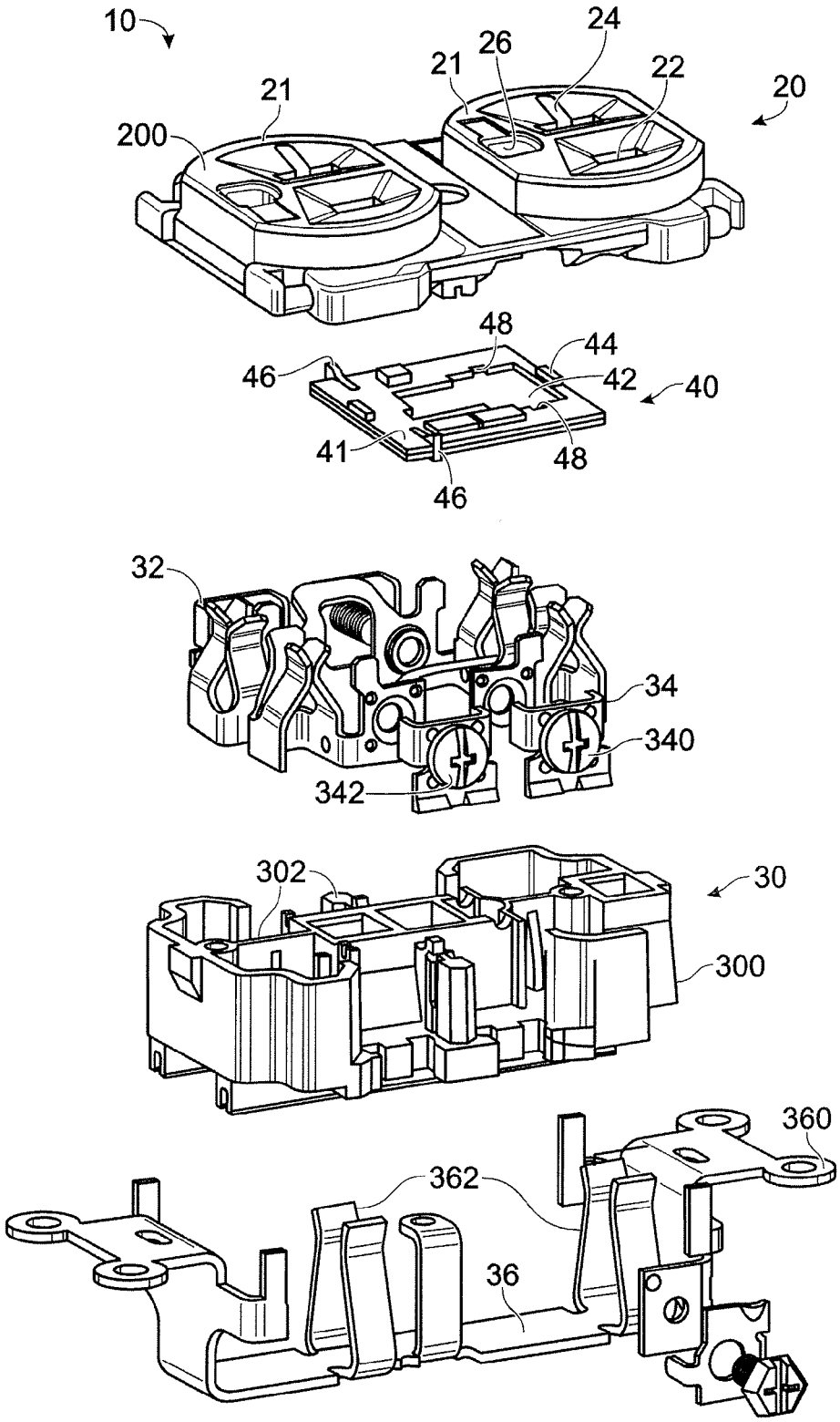
FIG. 9 is an exploded perspective view of a third embodiment of an electrical wiring system according to the present invention.

As embodied herein and depicted in FIG. 9, an exploded perspective view of a third embodiment of the present invention is disclosed. Like the first two embodiments, the electrical wiring system 10 includes a front cover assembly 20, a back body assembly 30, and a light assembly 40. The front cover assembly 20 is very similar, if not identical, to the previous embodiments, and includes a front cover member 200 that includes two face receptacles 21 formed at either end. Each face receptacle 21 has a hot blade opening 22, a neutral blade opening 24, and a ground prong openings 26 formed therein. A light assembly 40 is disposed within an interior portion of the front cover assembly 20 in manner previously described. The aperture 42 depicted in FIG. 9 is similar to the one shown in FIG. 4.

The rear body assembly 30 is different from the earlier embodiments. The rear receptacle is replaced by neutral side screw terminals (320, 322), which are not shown in this view, and hot side screw terminals (340, 342). The rear body member 300 is formed with various features that accommodate the terminal structures (32, 34), the ground strap 36, mounting ears 360, and the ground receptacles 362.

Figure 10:
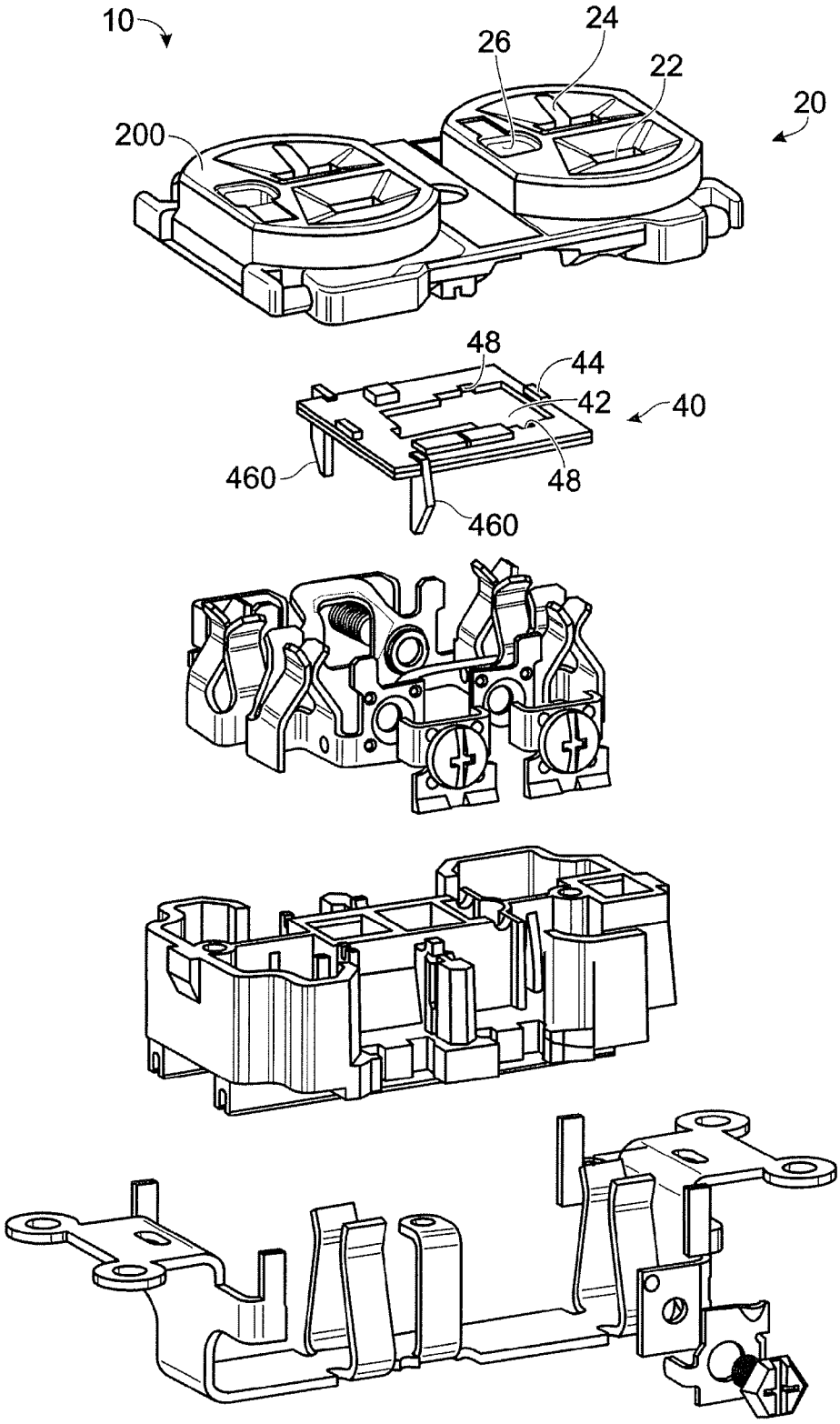
FIG. 10 is an exploded perspective view of a fourth embodiment of an electrical wiring system according to the present invention.

FIG. 10 is an exploded perspective view of a fourth embodiment of an electrical wiring system according to the present invention. FIG. 10 is almost identical to the embodiment depicted in FIG. 9. The power connection leads 46 employed in FIG. 9 are replaced by power connection clips 460. Further, the aperture 42 depicted in FIG. 10 is similar to the one shown in FIG. 1.

Figure 11A:
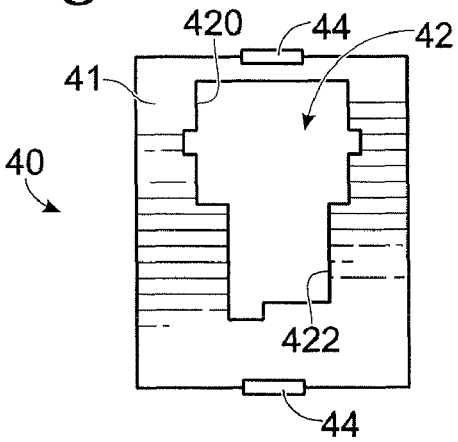
FIGS. 11A to 11C are top views of three embodiments of printed circuit boards for use in various embodiments of the present invention.
Figure 11B:
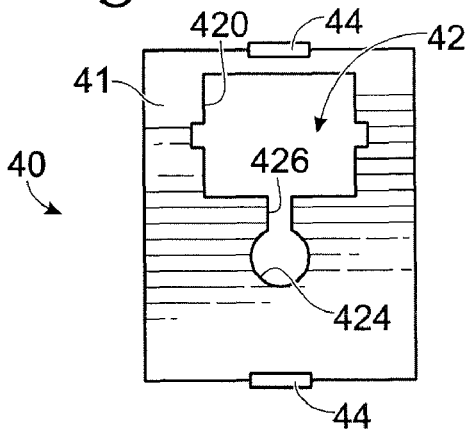
Figure 11C:
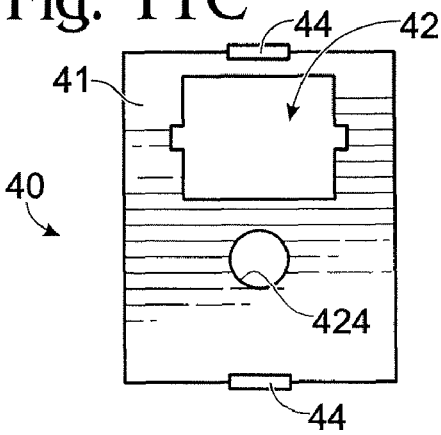

As embodied herein and depicted in FIGS. 11A to 11C, various top views of printed circuit board (PCB) 41 are disclosed. In each of these embodiments, the configuration of aperture 42 is varied in accordance with the geometry of the cover member 200. In FIG. 11A, aperture 42 includes a first rectangular portion that accommodates the interior ground prong chamber 260 and a second rectangular portion that accommodates the rectangular ribbing 280 that is disposed in the front cover 200 around ground screw opening 28 (See FIG. 2). In FIG. 11B, the second rectangular portion 422 is replaced by a "cul-de-sac" feature comprising circular portion 424 and connective opening 426. FIG. 11C includes two apertures: rectangular aperture 42 and circular aperture 424. A portion of the LED 44 housing may be positioned outside the perimeter of PCB 41. Accordingly, light directed from LED 44 that would otherwise be blocked by PCB 41 is then able to reflect off surfaces in receptacle interior 202 that otherwise would not be illuminated.

Figure 12:
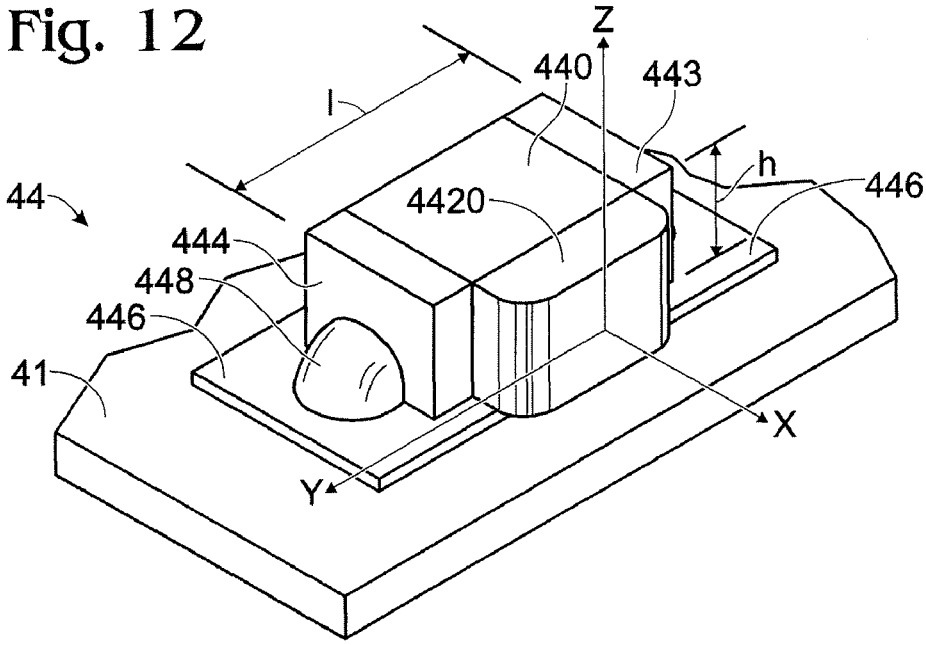
FIG. 12 is a perspective view of an LED for use in various embodiments of the present invention.

As embodied herein and depicted in FIG. 12, a perspective view of LED assembly 44 is disclosed. The LED assembly 44 includes a body member 440 coupled to a lens 442. Lens cap 4420 is substantially coplanar relative to the top surface of body member 440. The body member has an LED cathode structure 443 and an LED anode 444 connected to PCB solder pads 446 by solder connections 448. Body member 440 has a height dimension "h" and a length dimension "l". The LED assembly 44 is, as shown in the various embodiments of the present invention, disposed in LED illumination region 206 within interior region 202 (FIG. 3). In one embodiment, the distance between lens cap 4420 and the plane formed by floors (220, 240) is approximately 0.300 inches. For example, in one embodiment, the distance is substantially 0.262 inches. In general, the distance may be within an approximate range between 0.20 inches and 0.40 inches.

Cartesian coordinates are shown with the origin located on lens 442 at approximately the midpoint of the "h" and "l"

dimensions. The plane formed by the "x" dimension and the "y" dimension (x-y plane) is substantially parallel to the plane formed by floors (220, 240) and the plane formed by PCB 41. The lens element 442 is characterized by an illumination distribution pattern that is centered on the x-y plane. In other words, the intensity of the emitted illumination is greatest along the x-y plane and tapers off as one travels away from the x-y plane in the z-dimension toward floors (220, 240). Thus, the light rays emitted by lens 442 are directed toward the light reflecting surfaces 204 and are not directed onto floors (220, 240) or the neutral blade opening 24 and/or the hot blade opening 22.

Figure 13:
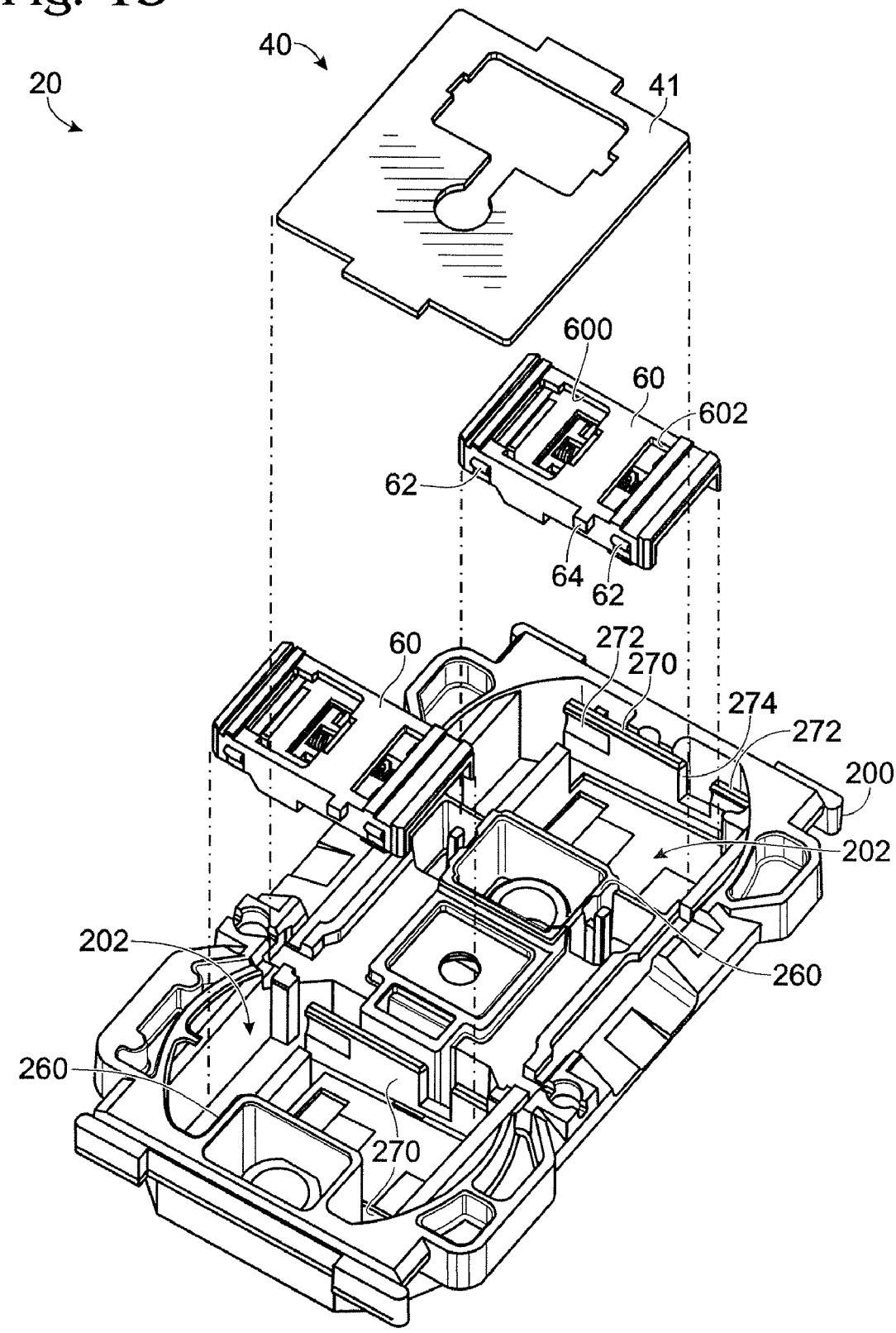
FIG. 13 is an exploded perspective view of a cover portion in accordance with a fifth embodiment of the present invention.

As embodied herein and depicted in FIG. 13, an exploded perspective view of a cover portion in accordance with a fifth embodiment of the present invention is disclosed. In this embodiment, the face receptacle interior 202 is modified to include shutter registration wall 270, which in conjunction with rectangular ground prong structure 260, is configured to accommodate translucent shutter member 60. The registration wall 270 includes registration chamfers 272 that accommodate lateral registration members 62 disposed on the side portion of the shutter 60. The registration wall 270 also includes a gap 274 that accommodates the movement of shutter alignment member 64.

Figure 14:
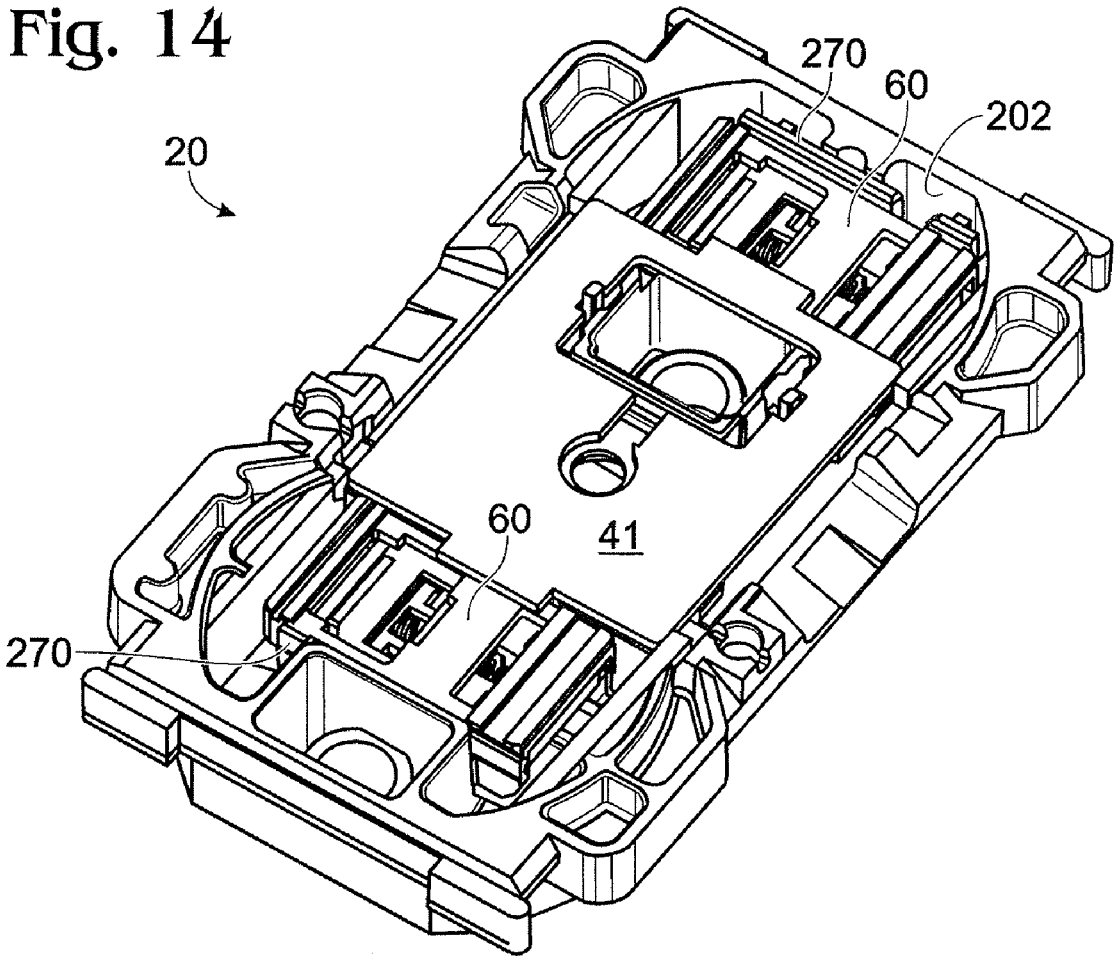
FIG. 14 is a perspective view of the cover member depicted in FIG. 13.

The shutter 60 includes a top shutter element and a bottom shutter element separated by a spring element. The openings 600 and 602 align with openings disposed in the bottom shutter element when the plug blades of a properly configured plug set are inserted into hot opening 22 and neutral opening 24. To be more precise, the plug blades force the top and bottom elements to move toward each other, placing the spring element into compression. When the plug blades are removed, the spring relaxes and urges the top and bottom shutter elements away from each other to close the shutter 60. As those skilled in the art might suspect, the shutters 60 prevent foreign objects (e.g., bobby pins wielded by children) from passing through to electrically energized components such as hot terminal structure 32 (See FIG. 1). FIG. 14 is a perspective view of the cover member depicted in FIG. 13 with the shutter 60 fully installed. In this embodiment, the registration walls 270 are configured to flex. When the shutter is pressed between the registration walls 270 disposed in interior region 202, the lateral registration members 62 snap into the registration chamfers 272.

Reference is made to U.S. patent application Ser. Nos. 10/729,685, 10/900,778, and 11/609,793, which are incorporated herein by reference as though fully set forth in its entirety, for a more detailed explanation of various embodiments of the protective shutter assembly 18.

In accordance with the present invention, the shutters 60 are fabricated using an optically transparent or translucent material such as polycarbonate, PVC, acrylic, polyoxymethylene, or any such suitable material. As those of ordinary skill in the art will appreciate, the shutters 60 function in the same manner as a light pipe. In other words, the shutters direct light from LEDs 44 into plug blade openings 22, 24.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. An electrical wiring device comprising:

a body member including a hot line terminal interface element and a neutral line terminal interface element accessible from an exterior portion of the body member, the body member also including a hot load contact structure electrically coupled to the hot line terminal interface element and a neutral load contact structure electrically coupled to the neutral line terminal interface element, both the hot load contact structure and the neutral load contact structure being disposed in an interior portion of the body member;

a cover member coupled to the body member and including at least one receptacle face structure, the at least one receptacle face structure including a set of receptacle outlet openings formed in a substantially planar portion thereof, the set of receptacle outlet openings including a neutral opening and a hot opening in alignment with the neutral load contact structure and the hot load contact structure, respectively, the at least one receptacle face structure forming an interior region including at least one reflective surface formed therein; and a light emission circuit assembly including at least one light emitting device disposed in the interior region, the at least one light emitting device being offset a predetermined distance from an interior surface of the substantially planar portion, the at least one light emitting device being configured to emit illumination in a plane that is substantially parallel to the interior surface such that the emitted illumination is diffusely reflected by the at least one reflective surface onto the interior surface of the planar portion and into the neutral opening and the hot opening.

2. The device of claim 1, wherein the at least one light emitting device obliquely transmits the emitted illumination onto the interior surface of the planar portion.

3. The device of claim 1, wherein the hot line terminal interface element and the neutral line terminal interface element include screw terminal elements partially disposed on an exterior portion of the body member.

4. The device of claim 3, further comprising a hot load screw terminal and a neutral load screw terminal partially disposed on an exterior portion of the body member.

5. The device of claim 1, wherein the hot line terminal interface element and the neutral line terminal interface element are formed in a predetermined pattern within an electrical interface structure disposed in the rear surface of the body member, the electrical interface structure being configured to receive a connector device having a plurality of connector contacts disposed in accordance with the predetermined pattern.

6. The device of claim 5, wherein the connector device is configured to directly terminate a plurality of AC electric power transmitting wires in a branch electrical circuit.

7. The device of claim 1, wherein the light emission circuit assembly is disposed on a printed circuit board.

8. The device of claim 1, wherein the predetermined distance is in an approximate range between 0.2 inches to 0.4 inches.

9. The device of claim 1, wherein the predetermined distance is approximately 0.3 inches.

10. The device of claim 1, wherein the at least one light emitting device includes a lens structure.

11. The device of claim 10, wherein the at least one light emitting device includes a plurality of LEDs disposed on at least one edge portion of the printed circuit board.

12. The device of claim 1, wherein the light emission circuit assembly includes a neutral wire interface and a hot wire interface configured to electrically connect the light emission control circuit assembly to the neutral load contact structure and the hot load contact structure, respectively.

13. The device of claim 12, wherein the at least one receptacle face structure is configured to compress the neutral wire interface against and the neutral load contact structure and the hot wire interface against the hot load contact structure when it is coupled to the body member.

14. The device of claim 1, wherein the light emission circuit assembly includes a neutral spring clip interface and a hot spring clip interface configured to electrically connect the light emission control circuit assembly to the neutral load contact structure and the hot load contact structure, respectively.

15. The device of claim 14, wherein the neutral spring clip interface is compressed between the printed circuit board and a surface of the neutral load contact structure and the hot spring clip interface is compressed between the printed circuit board and a surface of the hot load contact structure.

16. The device of claim 1, wherein the light emission circuit assembly comprises:

a plurality of light emitting diodes; and a light emission control circuit disposed between the hot load contact structure and the neutral load contact structure, the light emission control circuit being configured to energize or deenergize the light emitting diodes in response to a predetermined stimulus.

17. The device of claim 16, wherein the light emission control circuit and the plurality of light emitting diodes are disposed in series across the hot load contact structure and the neutral load contact structure.

18. The device of claim 16, wherein the light emission control circuit and the plurality of light emitting diodes are disposed on a printed circuit board.

19. The device of claim 1, wherein the light emission control circuit includes an ambient light sensor coupled to a control circuit, the control circuit being configured to energize the light emitting diodes in response to an amount of current flowing through the ambient light sensor falling below a predetermined threshold.

20. The device of claim 1, wherein the light emission circuit assembly further comprises:

a user accessible control element; and a dimmer circuit coupled to the user accessible control element and the plurality of light emitting diodes, the dimmer circuit being configured to regulate an intensity of light being emitted by the plurality of light emitting diodes.

21. The device of claim 1, wherein the light emission circuit assembly is configured to energize the at least one light emitting device when AC power is coupled to the hot line terminal interface element and the neutral line terminal interface element.

22. The device of claim 1, wherein the light emission circuit assembly includes at least one switch element coupled to the neutral opening or the hot opening, the light emission control circuit deenergizing the plurality the at least one light emitting device when a set of plug blades is inserted into the at least one set of receptacle outlet openings.

23. The device of claim 1, wherein the electrical wiring device is selected from a group of devices that includes a ground fault circuit interrupter, an arc fault circuit interrupter, a transient overvoltage detection device, a sensor, a wall switch, a duplex wall receptacle, a decorator wall receptacle, a multiple outlet strip (MOS), an extension cord, a power adapter, or a raceway.

24. The device of claim 1, further comprising an optically transmissive protective shutter assembly disposed in the at least one receptacle face structure between the set of receptacle outlet openings and the hot load contact structure and the neutral load contact structure, the protective shutter assembly being configured to move from a closed position to an open position in response to engaging a set of plug blades, the optically transmissive protective shutter assembly transmitting the illumination reflected by the at least one reflective surface onto the planar portion and into the neutral opening and the hot opening.

25. The device of claim 24, wherein the at least one protective shutter assembly is a frameless shutter assembly comprising a first shutter member and a second shutter member configured to move from a closed position to an open position only in response to engaging a set of plug blades having at least one predetermined plug blade geometry.

26. The device of claim 25, wherein the first shutter member and the second shutter member include shutter features configured to prevent the protective shutter assembly from being driven from the closed position into the open position if only one object is inserted into only one receptacle opening, or if two foreign objects are inserted into two receptacle openings of a set of receptacle openings, or if a set of plug blades that does not have at least one predetermined plug blade geometry is inserted into the set of receptacle openings.

27. The device of claim 25, wherein the light emission circuit assembly further comprises an optically transmissive element disposed between the at least one light emitting device and the frameless shutter assembly, the optically transmissive element being configured to backlight the frameless shutter assembly in a light emitting state.

28. The device of claim 1, wherein the set of receptacle openings includes a ground opening.

29. An electrical wiring device comprising:

a body member including a hot line terminal interface element and a neutral line terminal interface element accessible from an exterior portion of the body member, the body member also including a hot load contact structure electrically coupled to the hot line terminal interface element and a neutral load contact structure electrically coupled to the neutral line terminal interface element, both the hot load contact structure and the neutral load contact structure being disposed in an interior portion of the body member;

a cover member coupled to the body member and including at least one receptacle face structure, the at least one receptacle face structure including a set of receptacle outlet openings formed in a planar portion thereof, the set of receptacle outlet openings including at least a neutral opening and a hot opening in alignment with the neutral load contact structure and the hot load contact structure, respectively, the at least one receptacle face structure forming an interior region including at least one reflective surface formed therein; and a light emission circuit assembly including a printed circuit board disposed in alignment with the interior region and at least one light emitting device disposed on the printed circuit board, the printed circuit board and the at least one light emitting device being offset a predetermined distance from an interior surface of the planar portion, the at least one light emitting device being configured to emit illumination in a plane that is substantially parallel to the planar portion such that the emitted illumination is diffusely reflected by the at least one reflective surface onto the interior surface of the planar portion and into the neutral opening and the hot opening.

30. The device of claim 29, wherein the at least one receptacle face structure includes a first receptacle face structure and a second receptacle face structure.

31. The device of claim 29, wherein the cover member includes a mounting structure configured to secure the printed circuit board to the cover member in alignment with the at least one receptacle face structure.

32. The device of claim 31, wherein the mounting structure includes at least one chamfered mounting post and clip structure.

33. The device of claim 32, wherein the at least one chamfered mounting post and clip structure includes a first chamfered mounting post and clip structure and second chamfered mounting post and clip structure coupled to an electrically isolating wall surrounding a ground opening, the printed circuit board including at least one mounting aperture configured to accommodate the electrically isolating wall, the first chamfered mounting post and clip structure and the second chamfered mounting post and clip structure securing the printed circuit board to portions of the electrically isolating wall.

34. The device of claim 29, wherein the predetermined distance is in an approximate range between 0.2 inches to 0.4 inches.

35. The device of claim 29, wherein the predetermined distance is approximately 0.3 inches.

36. The device of claim 29, wherein the hot line terminal interface element and the neutral line terminal interface element are formed in a predetermined pattern within an electrical interface structure disposed in the rear surface of the body member, the electrical interface structure being configured to receive a connector device having a plurality of contacts disposed in accordance with the predetermined pattern.

37. The device of claim 36, wherein the connector device is configured to directly terminate a plurality of AC electric power transmitting wires in a branch electrical circuit.

38. The device of claim 29, wherein the at least one light emitting device includes a plurality of LEDs disposed on at least one edge portion of the printed circuit board.

39. The device of claim 29, wherein the at least one light emitting device includes a lens structure.

40. The device of claim 29, wherein the light emission circuit assembly includes a neutral wire interface and a hot wire interface configured to electrically connect the light emission control circuit assembly to the neutral load contact structure and the hot load contact structure, respectively.

41. The device of claim 40, wherein the at least one receptacle face structure is configured to compress the neutral wire interface against and the neutral load contact structure and the hot wire interface against the hot load contact structure when it is coupled to the body member.

42. The device of claim 29, wherein the light emission circuit assembly includes a neutral spring clip interface and a hot spring clip interface configured to electrically connect the light emission control circuit assembly to the neutral load contact structure and the hot load contact structure, respectively.

43. The device of claim 42, wherein the neutral spring clip interface is compressed between the printed circuit board and a surface of the neutral load contact structure and the hot spring clip interface is compressed between the printed circuit board and a surface of the hot load contact structure.

44. The device of claim 29, wherein the light emission circuit assembly comprises:

a plurality of light emitting diodes; and a light emission control circuit disposed between the hot load contact structure and the neutral load contact structure, the light emission control circuit being configured to energize or deenergize the light emitting diodes in response to a predetermined stimulus.

45. The device of claim 44, wherein the light emission control circuit and the plurality of light emitting diodes are disposed in series across the hot load contact structure and the neutral load contact structure.

46. The device of claim 29, wherein the light emission control circuit includes an ambient light sensor coupled to a control circuit, the control circuit being configured to energize the light emitting diodes in response to an amount of current flowing through the ambient light sensor falling below a predetermined threshold.

47. The device of claim 29, wherein the light emission circuit assembly further comprises:

a user accessible control element; and a dimmer circuit coupled to the user accessible control element and the plurality of light emitting diodes, the dimmer circuit being configured to regulate an intensity of light being emitted by the plurality of light emitting diodes.

48. The device of claim 29, wherein the light emission circuit assembly is configured to energize the at least one light emitting device when AC power is coupled to the hot line terminal interface element and the neutral line terminal interface element.

49. The device of claim 29, wherein the light emission circuit assembly includes at least one switch element coupled to the neutral opening or the hot opening, the light emission control circuit deenergizing the plurality the at least one light emitting device when a set of plug blades is inserted into the at least one set of receptacle outlet openings.

50. The device of claim 29, wherein the electrical wiring device is selected from a group of devices that includes a ground fault circuit interrupter, an arc fault circuit interrupter, a transient overvoltage detection device, a sensor, a wall switch, a duplex wall receptacle, a decorator wall receptacle, a multiple outlet strip (MOS), an extension cord, a power adapter, or a raceway.

51. The device of claim 29, further comprising an optically transmissive protective shutter assembly disposed in the at least one receptacle face structure between the set of receptacle outlet openings and the hot load contact structure and the neutral load contact structure, the protective shutter assembly being configured to move from a closed position to an open position in response to engaging a set of plug blades, the optically transmissive protective shutter assembly transmitting the illumination reflected by the at least one reflective surface onto the first portion and into the neutral opening and the hot opening.

52. The device of claim 51, wherein the at least one protective shutter assembly is a frameless shutter assembly comprising a first shutter member and a second shutter member configured to move from a closed position to an open position only in response to engaging a set of plug blades having at least one predetermined plug blade geometry.

53. The device of claim 52, wherein the first shutter member and the second shutter member include shutter features configured to prevent the protective shutter assembly from being driven from the closed position into the open position if only one object is inserted into only one receptacle opening, or if two foreign objects are inserted into two receptacle openings of a set of receptacle openings, or if a set of plug blades that does not have at least one predetermined plug blade geometry is inserted into the set of receptacle openings.

54. The device of claim 52, wherein the light emission circuit assembly further comprises an optical transmissive element disposed between the at least one light emitting device and the frameless shutter assembly, the interior light transmissive element being configured to backlight the frameless shutter assembly in a light emitting state.

55. The device of claim 29, wherein the set of receptacle openings includes a ground opening.

56. An electrical wiring device comprising:

a body member including a hot line terminal interface element and a neutral line terminal interface element accessible from an exterior portion of the body member, the body member also including a hot load contact structure electrically coupled to the hot line terminal interface element and a neutral load contact structure electrically coupled to the neutral line terminal interface element, both the hot load contact structure and the neutral load contact structure being disposed in an interior portion of the body member;

a cover member coupled to the body member and including at least one receptacle face structure, the at least one receptacle face structure including a set of receptacle outlet openings formed in a planar portion thereof, the set of receptacle outlet openings including at least a neutral opening and a hot opening in alignment with the neutral load contact structure and the hot load contact structure, respectively, the at least one receptacle face structure forming an interior region including at least one reflective surface formed therein; and a light emission circuit assembly including a printed circuit board disposed in alignment with the interior region and at least one light emitting device disposed on the printed circuit board, the printed circuit board and the at least one light emitting device being offset a predetermined distance from an interior surface of the planar portion, the at least one light emitting device being configured to emit illumination in a plane that is substantially parallel to the planar portion; and an optically transmissive protective shutter assembly coupled to the at least one light emitting device and disposed in the at least one receptacle face structure between the set of receptacle outlet openings and the hot load contact structure and the neutral load contact structure, the protective shutter assembly being configured to move from a closed position to an open position in response to engaging a set of plug blades, the optically transmissive protective shutter assembly being configured to direct at least a portion of the emitted illumination onto the planar portion, the neutral opening and the hot opening.

57. The device of claim 56, wherein the at least one protective shutter assembly is a frameless shutter assembly comprising a first shutter member and a second shutter member configured to move from a closed position to an open position only in response to engaging a set of plug blades having at least one predetermined plug blade geometry.

58. The device of claim 57, wherein the first shutter member and the second shutter member include shutter features configured to prevent the protective shutter assembly from being driven from the closed position into the open position if only one object is inserted into only one receptacle opening, or if two foreign objects are inserted into two receptacle openings of a set of receptacle openings, or if a set of plug blades that does not have at least one predetermined plug blade geometry is inserted into the set of receptacle openings.

59. The device of claim 57, wherein the light emission circuit assembly further comprises an optical transmissive element disposed between the at least one light emitting device and the frameless shutter assembly, the interior light transmissive element being configured to backlight the frameless shutter assembly in a light emitting state.

* * * * *